United States Patent [19]

Ohyama et al.

[11] 3,933,493

[45] Jan. 20, 1976

[54] AMIDRAZONES AS DYE COMPONENTS AND DEVELOPER SCAVENGERS IN DIFFUSION TRANSFER MATERIALS AND PROCESSES

[75] Inventors: Yasushi Ohyama; Hideo Sumitani, both of Kyoto, Japan

[73] Assignee: Mitsubishi Paper Mills, Ltd., Tokyo, Japan

[22] Filed: July 3, 1972

[21] Appl. No.: 268,264

[30] Foreign Application Priority Data

July 2, 1971 Japan ..... 46-48756

[52] U.S. Cl. ..... 96/29 D; 96/3; 96/56; 96/77

[51] Int. Cl.[2] ... G03C 7/00; G03C 5/54; G03C 1/40

[58] Field of Search ..... 96/3, 9, 77, 29 D, 56

[56] References Cited

UNITED STATES PATENTS

| | | | |
|---|---|---|---|
| 3,180,734 | 4/1965 | Willems et al. | 96/56 |
| 3,384,484 | 5/1968 | Schranz et al. | 96/9 |
| 3,467,520 | 9/1969 | Puschel et al. | 96/9 |
| 3,628,952 | 12/1971 | Puschel et al. | 96/3 |
| 3,730,713 | 5/1973 | Abbott | 96/3 |

*Primary Examiner*—David Klein
*Assistant Examiner*—Richard L. Schilling
*Attorney, Agent, or Firm*—Sughrue, Rothwell, Mion, Zinn & Macpeak

[57] ABSTRACT

A quick diffusion transfer process of forming color positive images by combining a photosensitive material portion prepared by superposing a photosensitive silver halide emulsion layer containing an amidrazone which becomes diffusible by an oxidation treatment (Type A) with an intermediate layer containing an amidrazone which does not become diffusible by the oxidation treatment (Type B) and an image-receiving material portion prepared by coating a composition containing an acid resistant coupler capable of forming a dye by the oxidative coupling with an amidrazone, exposing and black-and-white-developing the combined materials, subjecting material to an oxidation treatment in the superposed relationship to form color images, and then removing said photosensitive material portion.

A combined photographic material for forming color positive images having the above-mentioned photosensitive material portion and the image-receiving material portion on different supports respectively or on the same support in a superposed relationship.

A color positive image forming process comprising superposing an image of a color other than the amidrazone system utilizing a color developing system with the color positive image obtained above.

9 Claims, No Drawings

AMIDRAZONES AS DYE COMPONENTS AND DEVELOPER SCAVENGERS IN DIFFUSION TRANSFER MATERIALS AND PROCESSES

BACKGROUND OF THE INVENTION

1. Field of the Invention

The present invention relates to a quick diffusion transfer process of forming color positive images using amidrazones and also to a photographic material for forming color positive images.

2. Description of the Prior Art

An amidrazone is the name given to the compounds investigated by S. Hunig et al and it is perhaps considered that the name is an abbreviation for amido-hydrazone. The amidrazone was, at first, defined to be shown by the general formula I or II

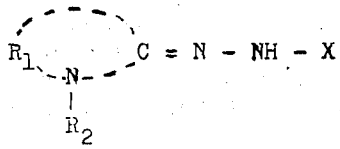

(I)

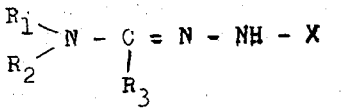

(II)

wherein X represents a hydrogen atom or

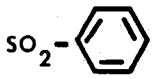

That is, the compounds investigated first were those represented by the general formula I and it was reported that among those compounds, the compounds of the formulae

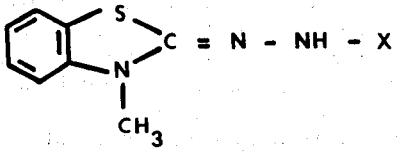

(Ia)

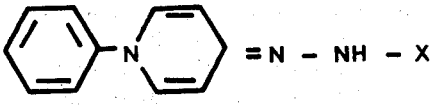

(Ib)

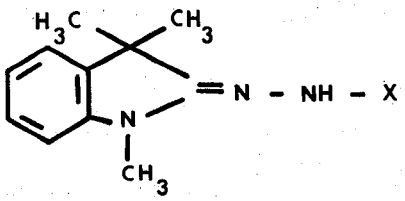

(Ic)

formed azo dyes by oxidative couplings with phenols, aromatic amines, or active methylene compounds using ferricyanide as an oxidizing agent [see, S. Hunig et al; "Agnew. Chemie," 70, 215(1958), "Ann. Chem.," 609, 160(1957), and ibid., 191(1959)]. Thereafter, many other compounds of the formula I and further open ring type amidrazones of the formula II described above were reported [see, "Ann. Chem., 651, 75(1962), etc.]. As the practical examples of the compounds of the formula II, the following compounds were shown:

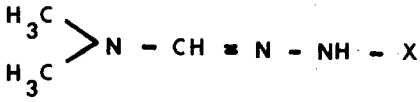

(IIa)

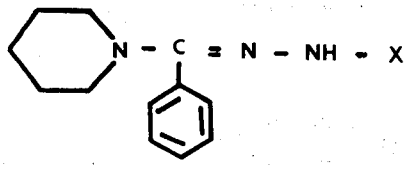

(IIb)

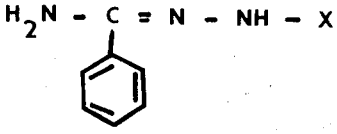

(IIc)

Furthermore, it was discovered that the compounds shown by the following formulae, which were considered to be amino-guanidine compounds, formed azo dyes by the same reaction as above;

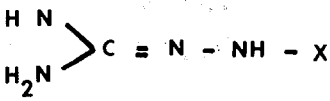

(IId)

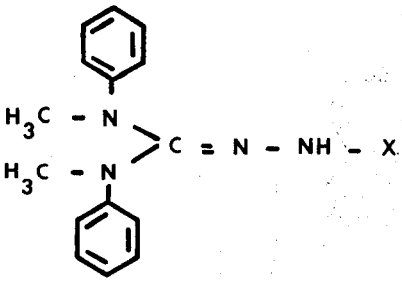

(IIe)

On the other hand, J. Jeaken et al also made other investigations of the above-mentioned compounds at about the same time, that is the invention of the application of the compounds to photography was issued to Gevaert A. G. in 1961 as British Pat. No. 915,932 which was filed in 1959. In the patent the compounds of the general formula II indicated above are clasified into the aforesaid open chain type amidrazones represented by the formula II and the compounds of the general formula II wherein $R_1$ and $R_2$ form a ring and the latter type of the compounds was represented, for convenience, by the general formula III (the compounds of the aforesaid group IIb belong to the compounds of the formula III);

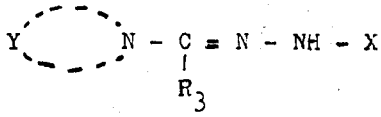

(III)

wherein

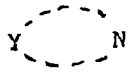

represents morpholine

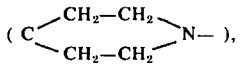

piperidine

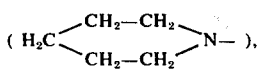

or piperazine

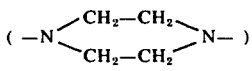

The compound having the following structure which has hydrazones at both ends of the piperazine ring is also included in the group of the formula III;

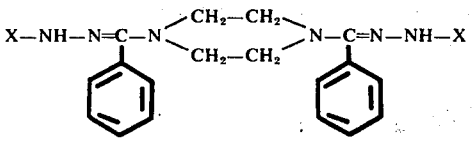

Furthermore, the following complicated compounds were added to the group of the heterocyclic amidrazones represented by the formula I;

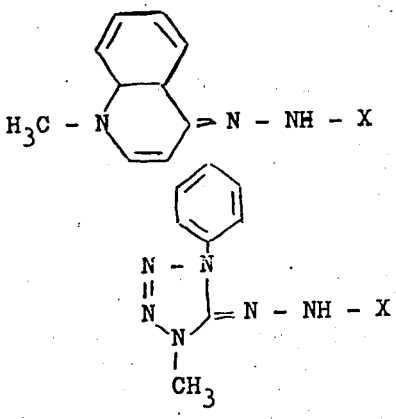

and

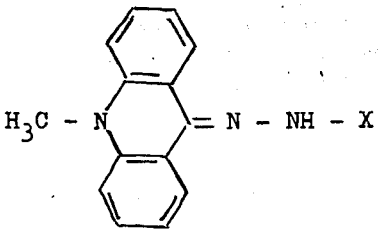

Moreover, the scope of X was expanded to include, besides a hydrogen atom and

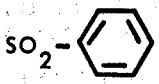

$CONH_2$, $SO_2$—CH, $SO_2$—$NH_2$,

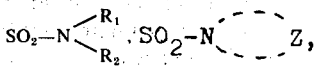

and $SO_2$—R (wherein R represents an alkyl group, an aryl group, a substituted alkyl group, or a substituted aryl group.)

In a conventionally known color positive system using those amidrazones, dyes are formed in thick photosensitive emulsion layers coated in superposed relationship, which makes it necessary to further fix and wash the emulsion layers after subjecting the emulsion layers to development and oxidative coloring (bleaching) processing.

Also, because in the color positive materials of a conventional amidrazone system, the whole sensitive dyes are left after processing, the thick layer of gelatin or other binder itself is colored and further part of the remaining sensitive dyes is adsorbed thereon. Still further, besides the desired dye image and unreacted couplers, considerable stains tend to be left caused by remaining red-brown silver sulfide which is imperfectly bleached or the contamination of the binder from many processing baths and thus the blank portion of the photosensitive material is apt to be stained.

Furthermore, the compound formed by the reaction of the intermediate oxidation product of a developing agent and the amidrazone, which is considered to be substantially colorless and stable, usually has a color to some extent and is liable to be left in the emulsion layers. Therefore, it has not been determined whether such a photosensitive material can be stored for a long period of time without being colored or discolored since the technique has not yet been sufficiently investigated.

In the conventional Polacolor system and other similar diffusion transfer color photographic systems (see, specifications of British Pat. Nos. 840,731 and 904,364), it is required to process the photosensitive materials in the complete dark and thus those conventional systems are inconvenient for practical use.

SUMMARY OF THE INVENTION

Accordingly, an object of this invention is to provide a novel quick diffusion transfer process of forming color positive images capable of quickly obtaining color positive images.

Another object of this invention is to provide the aforesaid color positive image forming process wherein processings after the oxidative coloring treatment are simple, tha whole transparency is high, the formation of stains is less, the possibility of coloring and discoloring by preservation is reduced, silver can be recovered profitably, and further the processings in the complete dark are unnecessary after expsoure and black and white development.

Still another object of this invention is to provide a process capable of repeated transfer many times even from the duplication of other originals by other photosensitive materials.

A further object of this invention is to provide a process of forming color positive images widely applicable to form drawings and designs for industrial or building purposes by duplicating repeatedly with colors other than the amidrazone systems utilizing a color developing system.

Another object of this invention to to provide combined photographic materials for forming color positive images used for achieving the aforesaid objects of this invention.

The above objects of this invention can be attained by combining a photosensitive material portion prepared by superposing a photosensitive silver halide emulsion layer containing an amidrazone which becomes diffusible by an oxidation treatment, such as M-methylacridinic amidrazone with an intermediate layer between different kinds of emulsion layers, said intermediate layer containing an amidrazone which does not become diffusible by the oxidation treatment, such as a compound of AM-6 and an image-receiving material portion prepared by coating a composition containing a coupler capable of forming a dye by oxidative coupling thereof with an amidrazone, such as an α-naphthol type diffusion resistant coupler, subjecting the combined photographic materials to an oxidation treatment in close superposed relationship after subjecting the combined materials to exposure and black and white development to cause diffusion transfer and to cause oxidative coupling, whereby a color image is formed, and then removing the photosensitive material portion.

Also, by combining the above-mentioned photosensitive material portion and the image-receiving material portion, the combined photographic material of this invention for forming color positive images is obtained.

Also, after an ordinary silver halide photosensitive material for black and white photography is exposed and subjected to black and white development, the emulsion layer of the photographic material thus processed is closely brought into contact with the image-receiving layer having the color positive image formed by the above-mentioned process and a p-aminoaniline color developer is applied to them, whereby the intermediate oxidation product of the color developing agent is diffusion-transferred to cause oxidative coupling and to form a color positive image on said black and white silver halide photosensitive material.

DETAILED DESCRIPTION OF THE INVENTION

The amidrazones used in this invention are represented by the following general formula

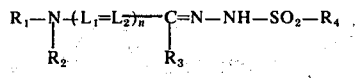

wherein $L_1$ and $L_2$ each represents —CH= or —N=; $R_1$, $R_2$, $R_3$, and $R_4$ each represents a hydrogen atom, an alkyl group, an aryl group, an aralkyl group, or an alkylaryl group; a part of the carbon chain of each of said groups may be substituted with O, S, or N; each of said groups may have an ordinary substituent such as a carboxylic acid group, a sulfonic acid group, or a halogen atom; said $R_2$ and said $R_1$ together may form a ring; and said $R_2$ may be combined with said $R_3$ to form a heterocyclic ring together with $-L_1=L_2-$; and $n$ is 0 or 1.

In addition, in this invention it is necessary to provide a diffusion resistant property to the amidrazone before incorporating the amidrazone in a photosensitive emulsion and thus $R_1$, $R_2$, $R_3$, and $R_4$ of the aforesaid general formula must be so selected that at least one of said groups has a hydrocarbon group having more that 10 total carbon atoms as a ballast group. However, as will be stated later, the property or the function of the amidrazone is greatly influenced by the position having the ballast group and thus the amidrazone having a ballast group at the group $R_4$ is called Type A, while the amidrazone having ballast group at the group $R_1$, $R_2$, or $R_3$ is called Type B. The ballast groups will be explained in detail later.

The fundamentals of the aforesaid oxidative coupling reactions of the amidrazones as mentioned before with phenols, aromatic amines, or active methylene compounds will be explained more in detail below. That is, the reaction of the basic heterocyclic amidrazone of formula I having no diffusion resistant property and α-naphthol or a 5-pyrazolone derivative which is a typical phenol or a typical active methylene compound and has been widely used in color development for color photography as a coupler for cyan or magenta respectively is shown by the following structural formula; that is

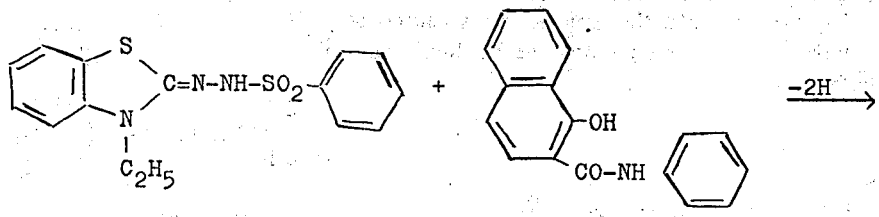

(heterocyclic amidrazone, AM-1) (α-naphthol type coupler)

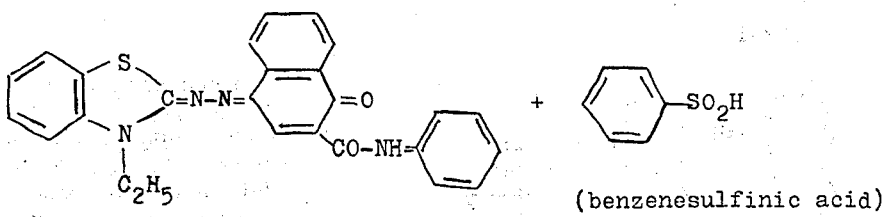

(red-purple dye) (benzenesulfinic acid)

That is, by the reactions of the heterocyclic amidrazone and α-naphthols, a blue, purple or red dye is formed depending upon the structure of the nucleus. Furthermore, the reaction with a 5-pyrazolone derivative is as follows;

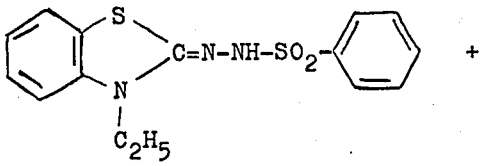

(AM-1)

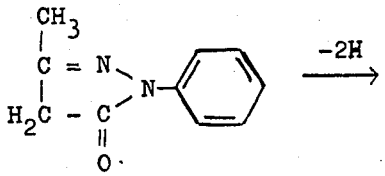

(5-pyrazolone coupler)

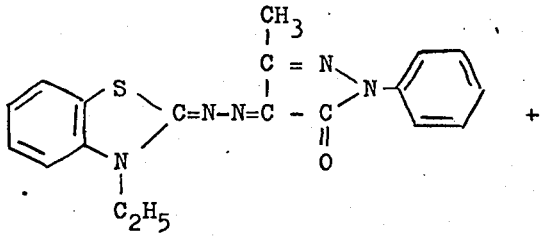

(orange dye)

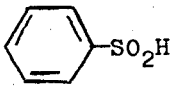

That is, generally a yellow or red-orange dye is formed.

The same amidrazone as above causes also an oxidative coupling with an aromatic amine to form a darker color dye. For example, the amidrazone is caused to react with 1-phenylaminonaphthalene-8-sulfonic acid as follows;

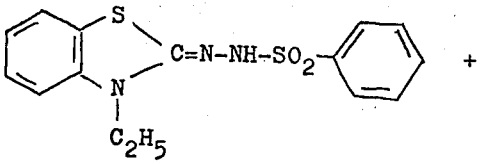

(AM-1)

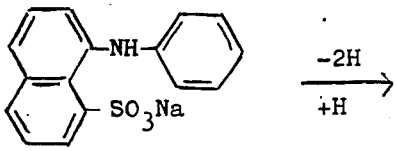

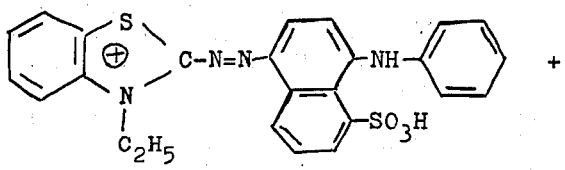

(blue dye ion)

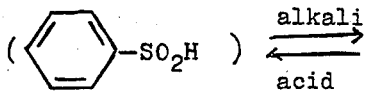

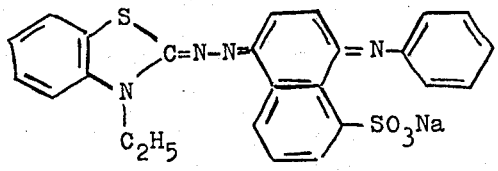

(red-brown dye)

That is a blue color is usually formed by the reaction.

On the other hand, the open chain type amidrazones of the formula II for light color dyes, by reaction with the same couplers as above, for example, form a yellow dye as shown below;

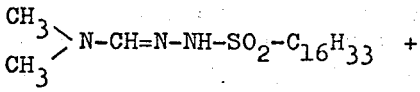

(diffusion resistant open chain amidrazone, AM-2)

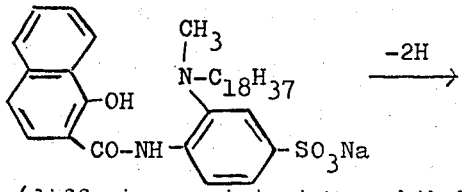

(diffusion resistant α-naphthol type coupler)

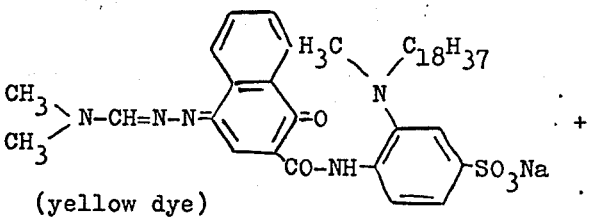

(yellow dye)

As mentioned above the heterocyclic amidrazones of the formula I form blue, purple or red dyes by reaction with α-naphthols, while the amidrazone having the acridine nucleus shown by the following formula provides a dye of the deepest color and forms a cyan color with an α-naphthol. That is;

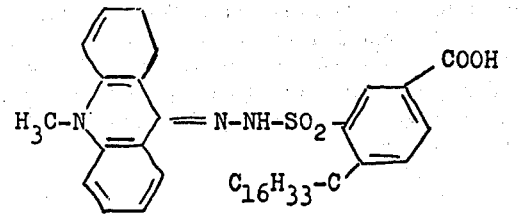

(M-methylacridinic amidrazone, AM-3)

+

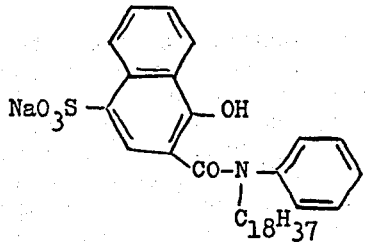

(α-naphthol type coupler)

-2H →

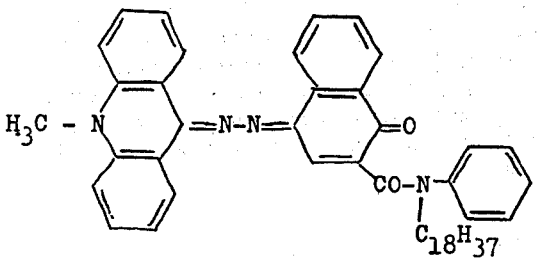

(cyan color dye)

+

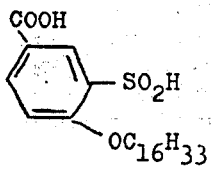

Furthermore, besides the aforesaid aromatic amines which are not used as couplers for color development, the 2-aminothiazole coupler, 5-aminopyrazoline coupler, and 1-phenylpyrazoline coupler having the following skeletons have been developed by Jeaken et al:

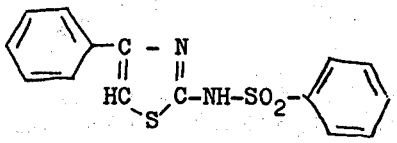

,

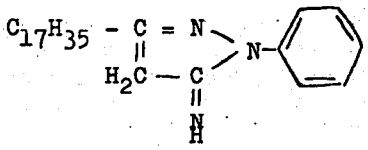

, and

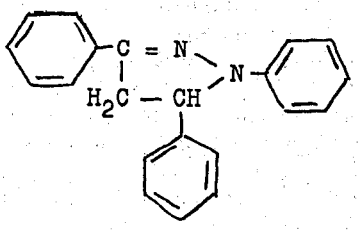

The above couplers cause oxidative coupling with a most general benzothiazole amidrazone, such as AM-1 as mentioned above or the diffusion resistant amidrazone AM-4 having the following formula to form magenta, yellow, and cyan dyes respectively:

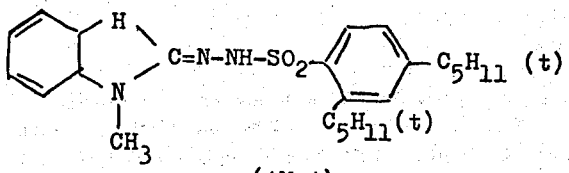

(AM-4)

In addition, the morpholinic amidrazones of the formula III give, in general, considerably light color dyes and the piperidinic amidrazones give deeper color dyes.

For example, the amidrazone, AM-5 having the following formula gives a yellow dye with an α-naphthol coupler;

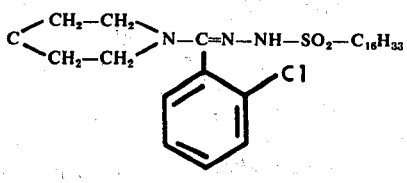

(AM-5)

On the other hand, the amidrazone, AM-6 having the following formula

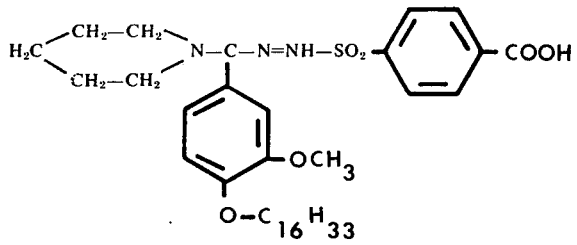

(AM-6)

gives a yellow dye with a 5-pyrazolone coupler and a red-purple dye with an α-naphthol coupler.

As the statement of S. Hunig et al, those dyes prepared above are diazo dyes and are considered to have an essentially stable structure and excellent moisture and heat resistance or light resistance different from indoaniline dyes and azomethine dyes obtained in conventional color development for color photography.

The durablilty of azo dyes depends upon the structure and the position of the substituent of each azo dye. However, there are many kinds of dyes obtained by the oxidative coupling of the amidrazones and the couplers are described above and the structures and the skeletons thereof are somewhat different from those of commercially available dyes and also there is no data at present comparing the moisture and heat resistance and light resistance between the dyes prepared by the above-mentioned oxidative couplings and commercially available azo dyes. But, because the dyes prepared by the oxidative couplings are essentially excellent in durability, it is clear that if properly selected, a color positive image having superior stability to those in conventional color photography is always obtained, which is one of the feature of this invention.

The coloring reaction by the aforesaid oxidative coupling reaction proceeds more smoothly and with a better yield in the amidrazones represented by the general formulae I, II, and III wherein X is

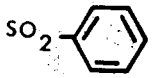

(or generally $-SO_2R$) than the amidrazones of the formulae I, II, and III wherein X is a hydrogen atom. In this case, it has been believed that at the beginning of the reaction, the bond between —NH— and $-SO_2-R$ of the hydrazone splits to form a nascent amidrazone intermediate oxidation product. Accordingly, among the diffusion resistant amidrazones represented by the following general formula

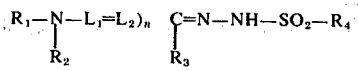

if in the diffusion resistant amidrazone of the Type A wherein $R_1$, $R_2$, and $R_3$ have no ballast group and only $R_4$ has a ballast group, such as AM-2, AM-3, AM-4, and AM-5 as mentioned above, the bond between —NH— and $-SO_2-$ thereof splits, the amidrazone loses its ballast group and becomes immediately diffusible. Thus, when a photosensitive emulsion layer containing such a diffusion resistant amidrazone is placed in an oxidation treatment bath, the amidrazone diffuses immediately into distant layers from the adjacent layer gradually and is transferred readily in the image-receiving layer containing a coupler, therein the amidrazone is caused to react with the coupler to form a dye.

On the other hand, in the amidrazone of the aforesaid general formula wherein a ballast group is not attached to $R_4$ but is attached to any one of $R_1$, $R_2$, and $R_3$, such as AM-6 mentioned above and those having the following formulae

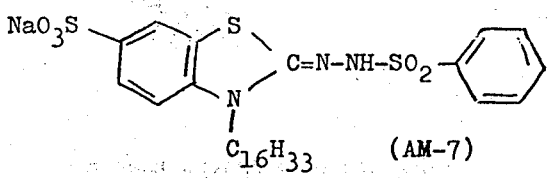

(AM-7)

and

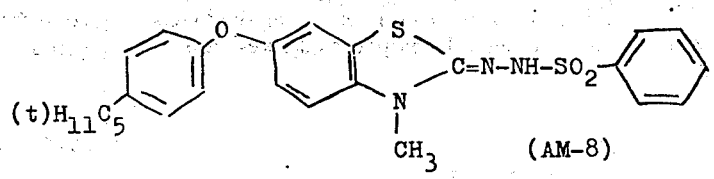

(AM-8)

the amidrazone itself or the intermediate oxidation product thereof will not lose its diffusion resistant property even if the bond between —NH— and $-SO_2-$ splits in view of the ballast group. Consequently, if a coupler has diffusion resistant properties and is not present in the photosensitive emulsion layer containing the above-mentioned amidrazone, the coupler is not coupled or colored.

Because of the above differences, although both type amidrazones are initially (prior to oxidative coupling) diffusion resistant, Type A should be discriminated from Type B.

On the other hand, another important chemical property common to the amidrazones is that they are converted into colorless and stable compounds, although the structures thereof as well as the mechanisms of forming such compounds are not clear at present, by reaction not only with a p-aminoaniline which is a developing agent in color development but also by reaction with the intermediate oxidation product of a developing agent for black and white development, such as hydroquinone, pyrocatechol, a p-aminophenol, 1-phenyl-5-pyrazolidone, or derivatives thereof and when the stable compounds are subjected to an oxidation treatment, they are not coupled with the coupler. The application of this fact is disclosed in the specification of U.S. Pat. No. 3,467,520 granted to W. Puschel and K. W. Schranz.

Thus, when a silver halide photosensitive emulsion layer containing the aforesaid diffusion resistant amidrazone of the Type A is exposed and developed in an ordinary black and white or color photographic developer, developed silver is reduced in conformity with the printed image and the amidrazone in the image-bearing areas is converted into a colorless stable compound in conformity with the image by reaction with the intermediate oxidation product of the developing agent formed during development and thus the remaining amidrazone forms as it is a positive latent image having reversed density to the printed negative image. Therefore, when a binder layer containing a diffusion resistant coupler is superposed with the aforesaid photosensitive emulsion layer containing the diffusion resistant amidrazone of the Type A and they are subjected to an oxidation treatment, the intermediate oxidation product of the type A amidrazone which has become diffusible as the result of splitting the bond between —NH— and —$SO_2$—diffuses into the binder layer containing the diffusion resistant coupler as mentioned before, whereby it causes oxidative coupling with the coupler to form a color positive image, that is, the latent image is transferred as a visible image. Thus, the binder layer containing the coupler is called the "image-receiving layer" in this invention.

A color photosensitive material is prepared by incorporating in two or three kinds of silver halide photosensitive emulsions having different color sensitivities as in ordinary color film or color photographic paper the different diffusion resistant amidrazones of the Type A matching to the color sensitivities of the emulsions instead of couplers and coating the photosensitive emulsions on a support in multi-layers. Apart from this, an image-receiving material is prepared by incorporating a coupler or couplers provided with a diffusion resistant property in a water-permeable binder such as gelatin and polyvinyl alcohol and coating the mixture on a paper or a film. When the color photosensitive material is exposed to or reprinted by a multi-color original such as an outdoor scene, an indoor still life, a person, a paint, and a color-printing drawing, subjected to black and white development and washed as in an ordinary photosensitive material, brought into contact with the image-receiving layer of the image-receiving material wetted with an oxidation treatment bath containing a ferricyanide (almost the same as a bleaching bath used in ordinary color photography), they are squeezed in the contacted state, and after allowing them to stand for a while, the photosensitive material is removed, the different amidrazones are transferred from the corresponding different emulsion layers having different color sensitivities onto the image-receiving layer imagewise, whereby the amidrazones are caused to react with the coupler or couplers to form superposed multi-color images on the image-receiving layer of the image-receiving material as is clear from the aforesaid explanation of the chemical reactions of the amidrazones.

However, since, in fact, the intermediate oxidation product of a developing agent formed by the development of a photosensitive emulsion layer diffuses into the other emulsion layers coated thereon in multi-layer relationship, the occurrence of color mixing is unavoidable by inserting an intermediate layer consisting of only binder between both emulsion layers and thus it has been desired to prevent the intermediate oxidation product of the developing agent from diffusing into the other emulsion layer from the emulsion layer containing it by incorporating in the intermediate layer between both emulsion layers a material capable of catching the intermediate oxidation product of the developing agent before it reaches the adjacent emulsion layer. It has been found that the diffusion resistant amidrazones of the Type B mentioned above are quite favorable for the purpose.

That is, as mentioned above, because it is believed that the amidrazone of this type becomes a stable colorless compound by reaction with the intermediate oxidation product of the developing agent and at the same time the intermediate oxidation product of the developing agent is reduced to be regenerated, if the amidrazone of the Type B is incorporated in the intermediate layer, the diffusion of the intermediate oxidation product from the emulsion layer containing it into the adjacent emulsion layer through the intermediate layer is prevented and at the same time the diffusion of the remaining unreacted amidrazone of the Type B into the image-receiving layer to cause a coupling reaction with the coupler in the image-receiving layer is prevented since even if the bond between —NH— and —$SO_2$— of the amidrazone splits during processing in an oxidation treatment bath, the amidrazone does not become diffusible.

That is, the amidrazone of the Type B in the intermediate layer has no relation to the coloring in the color photography of this invention but acts as a scavenger for intermediate oxidation product of the developing agent at development to prevent the occurence of color mixing. Such behaviors of the amidrazone have not hitherto been known.

However, the many amidrazones and couplers as mentioned above have been all reported in detail by Hunig et al and Jeaken as mentioned above and also by Puschel and co-workers and the processes of producing those compounds are also taught by them. That is, many of the amidrazones and couplers may be produced by those known processes and thus the processes of making those compounds are omitted from the specification of this invention. Furthermore, phenolic couplers, α-naphtholic couplers, and active methylenic couplers such as 5-pyrazolone couplers and acetanilide couplers which are a part of the couplers used in this invention and are widely used in a conventional color developing system for color photography may also be prepared by the known methods described in many reports and patent specifications and thus the processes of producing them are also omitted from this specification.

In addition, the above examples show the case of coating the photosensitive coating composition and the image-receiving coating composition on separate supports but they may be applied to the same support. That is, a photosensitive combined material prepared by forming first on a support an image-receiving layer consisting of a binder containing a coupler and having been subjected to a hardening treatment and then with or without forming thereon an intermediate layer, coating the desired layers (for example 3 emulsion layers and 2 intermediate layers) of photosensitive emulsions which have not been hardened or have been treated to become water soluble and intermediate layers may also be used in this invention. In this case, if the photosensitive combined material is, after exposure and development, washed with water, the photosensitive material portion is dissolved away. Thus, by washing the photosensitive combined material after exposure and development with an aqueous solution of 3–5% magnesium sulfate instead of using water to remove harmful components such as unnecessary developing agent, coating thereon uniformly a definite amount of an oxidation treatment liquid containing a ferricyanide as the main component followed by allowing to stand, and when a series of reactions such as the separation, diffusion transfer, and coupling reaction of the aforesaid intermediate oxidation product of the amidrazone are finished, stripping off only the photosensitive material portion or removing the photosensitive material protion by washing with water, the image-receiving layer having thereon a color positive image can be obtained on the support.

Also, a photosensitive combined material having the reverse layer structure prepared by coating on a support the photosensitive material portion in layers and then forming an image-receiving layer through an intermediate layer soluble in water or acid water may also be used in this invention. That is, the combined material thus prepared is, after exposure and development, processed in an aqueous solution of magnesium sulfate, subjected to an oxidation treatment, and then superposed immediately with a proper support such as water proof paper or a film base so that the uppermost image-receiving layer is brought into contact with the surface of the support followed by allowing it to stand. When a series of reactions as mentioned above are thus finished, the photosensitive material portion is separated from the image-receiving layer through the intermediate layer by pulling apart both supports in water or a weak acetic acid solution, whereby the desired color positive image can be obtained in the image-receiving layer completely attached to the new support. The photosensitive material portion may be disposed of together with the original support without being processed.

In the present invention, it is not required to conduct the process in the complete dark, that is, after exposure and black and white development, the subsequent processings may be conducted in the light. For example, by conducting the copying or exposure and black and white development (and stopping and washing) in the dark by utilizing an automatic copying machine very similar to a liquid development type electrophotographic copying machine sold and used widely at present, withdrawing the photosensitive material thus developed from the automatic copying machine, superposing the photosensitive material with an image-receiving material in the light, processing them in a developing transfer machine, which has widely been used as a copying machine of a silver complex salt diffusion transfer system, containing an oxidation treatment solution, squeezing the superposed materials thus processed, and after a while, removing the photosensitive material, a reproduction of a color positive multicolor image can be obtained on the image-receiving material very simply.

Furthermore, the transfer may be repeated many times from the print obtained by reproducing from other originals with other photosensitive materials. Also, because a reproduction of other color than that in the amidrazone system may be formed in duplication relationship with the color image by the amidrazone system by utilizing a color developing system as will be stated below, the present invention has such an advantage that the process of this invention can also be applied for obtaining combined figures of drawings and designs for industrial and structural purposes.

That is, the other coloring reaction by a photosensitive material in the color developing system utilizes the following reaction. Thus, because many of the couplers to be incorporated in the image-receiving layers in this invention are common to the couplers for color development as mentioned above, in the case of using, e.g., an α-naphtholic coupler, the amidrazone usually forms a magenta, red, orange or yellow dye with such a coupler but forms a cyan dye with the oxidation product of a p-aminoanilinic color developing agent. Therefore, by using a combination of a multi-layer photosensitive material prepared by using two proper kinds of the amidrazones and a non-dye-sensitized silver halide emulsion layer and a silver halide emulsion layer color sensitized in the green region and an image-receiving material having an image-receiving layer containing the α-naphtholic coupler, a dichromatic transfer image of, e.g., orange and magenta is formed. Also, other originals may be reproduced using an ordinary black and white silver halide photosensitive material (containing neither amidrazone nor coupler), wherein the photosensitive layer is subjected to black and white development in the dark, and washed with water. The black and white silver halide photosensitive material having the silver image is correctly superposed with the aforesaid image-receiving material having the dichromatic transfer image prepared above and then a color developer is applied between them by utilizing a developing machine for silver complex salt diffusion transfer system, whereby the undeveloped silver halide is developed and at the same time the intermediate oxidation product of the color developing agent thus formed diffuses from the image portion into the image-receiving layer to form a cyan dye by causing coupling with the coupler in the layer and to form a trichromatic image by superposing the cyan positive image with the dichromatic image of orange and magenta. The reaction is well known but the reaction system in which an α-naphtholic coupler and a p-diethylaminoaniline color developing agent are used is illustrated as follows;

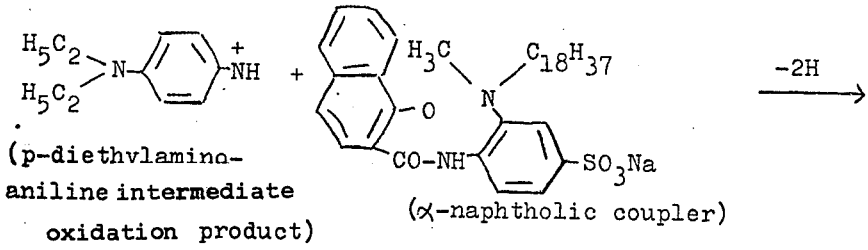

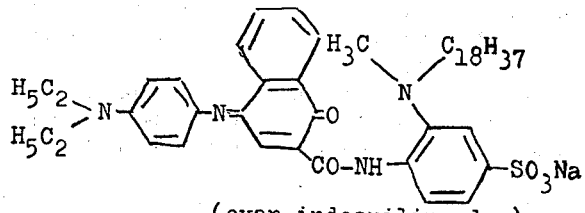

(cyan indoaniline dye)

In this system, the color tone is not so changed by changing slightly the p-aminoaniline derivative which is the developing agent and thus, in order to obtain multicolor image, different couplers must be used as is well known. The point that the color tone can be changed by changing not only the coupler but also the amidrazone in the amidrazone system is utilized in the present invention but it is also an important feature of this invention to be able to apply the combination of color developed images in the point that an image of another color can be superposed by using the same coupler and further the application is different from the conventioal color developing system and has its feature in the point that the coupler is separated from the photosensitive layer and only a color image is formed by transfer.

Now, the application of this invention will be explained below. Of course, according to the present invention general photographic color films and color papers for enlargement in the natural color photographic field can be produced by combining suitable amidrazone couplers and color sensitized high speed silver halide emulsions and further the present invention can be applied to such photographic color films as false color photography or pseudo color photography and also in an infrared aerial photography. Furthermore, from such excellent merits that the processings after the initial black and white development can be conducted in the light as mentioned above, a combination of different color images can be obtained with the same photosensitive material by changing only the image-receiving material, the kinds of colors can further be increased and other figures can be superposed with another figure by combining with other photosensitive materials containing different amidrazones, a color image or figure may be further superposed by combining with the aforesaid color developing system, and further the processing can be conducted rapidly and in various manners and the dyes prepared are stable, the applications to various fields such as the reproductions of complicated multi-color drawings, the combinations and colorings of designs, the manufacturings of printings and drawings for display, and other commercial, industrial, and architectural uses are expected.

In addition the system of introducing in a silver halide emulsion or an image-receiving layer the coupler or the amidrazone after providing thereto a diffusion resistant property will be finally explained. That is, in the process of this invention, the systems employed for providing a diffusion resistant property to couplers in color films or color printing papers for the multilayer emulsion system widely practiced at present may be effectively used. For example, there are a system wherein a coupler molecule is made alkali soluble by introducing into the molecule a chain-like hydrocarbon residual group having more than 10 carbon atoms, such as a dodecyl group, a hexadecyl group, and an octadecyl group and also introducing an anionic carboxylic acid residual group or sulfonic acid residual group therein and then the coupler is introduced as is in a binder such as a gelatin solution; a system wherein an alkylaryl group having more than 10 total carbon atoms, such as a 2,4-di-t-amylphenyl group a phenoxyphenyl group, and the like is introduced into a coupler molecule to make it oleophilic or to make it soluble in oil without being crystallized therein, the coupler is dissolved in a high boiling oil such as dibutylphthalate, tricresyl phosphate, veratrol (or 1,2-dimethoxybenzene), and dibutyllauramide, and the oil solution is dispersed in a binder such as a gelatin solution as fine oil droplets; and a system wherein the aforesaid oleophilic coupler is dissolved in a specific solvent immiscible with water, such as formamide and dimethylformamide and the solvent solution is dispersed as is in a binder.

Also, a method of providing a diffusion resistant property to a coupler by condensing the coupler with a high molecular weight material is also known and further a novel system developed by the inventors wherein a coacervation is caused from an anionic diffusion resistant material and a cationic polymer and a coupler is added to the binder as a fine dispersion thereof can also be employed in this invention. In any case, the principle is believed to be that the introduction of a side chain having a molecular weight higher than some level into the molecule acts as ballast by the association with a binder (a hydrophilic binder such as gelatin or an oleophilic binder such as a high boiling oil) to provide a diffusion resistant property.

Thus, the ballast groups to be introduced into the molecule of a coupler for providing a diffusion resistant property thereto may differ to some extent according to the systems to be employed as mentioned above but an alkyl group, an alkylaryl group, and an aralkyl group each having more than 10 total carbon atoms are considered similarly effective even if a part of the carbon chain thereof may have been unsaturated, may form a ring, or may have been substituted by oxygen, nitrogen or sulfur and thus, the term "a ballast group having more than 10 total carbon atoms" includes all of those groups as mentioned above.

The advantages of this invention will be further explained below in more detail.

Although the process of this invention may be the same as the conventionally known amidrazone system in the points that the processing steps are reduced and also an azo dye image stable to moisture, heat, and light is easily obtained, the process of this invention has further the following excellent points as comapred with the conventional amidrazone systems:

1. The process of this invention can be more rapidly and more simply conducted than the conventional amidrazone system. That is, in the conventional system, dyes are formed in thick photosensitive emulsion layers coated in multi-layers and thus after developing and oxidative coupling (bleaching) treatments, fixing and washing are required. On the other hand, in the present invention the process is finished by simply separating the image-receiving material or washing away the photosensitive material portion.

2. In the color photographic positive material for conventional amidrazone systems, the whole photosensitive material is left after processing. Therefore, the layer of a binder such as gelatin having a thickness many times thicker than the image-receiving layer of this invention has been sonsiderably colored as well as the remaining sensitive dye has been adsorbed therein. Furthermore, besides the desired dye image and unreacted coupler, considerable stains are apt to be left such as the insufficiently bleached red-brown residue of silver sulfide and the contamination of the binder from various processing baths. That is, there are remakable differences between the stains of the blank of the product of this invention and the stains of the blank of the product in the conventional system.

3. The preservability of the colorless and stable compound formed by the reaction of the intermediate oxidation product of the developing agent and the amidrazone has not yet been confirmed but such a point gives no trouble in this invention since the compound is disposed as is together with the photosensitive material portion in this invention.

4. In this invention, the unreacted coupler is left in the image-receiving layer besides the desired color positive image. However, in a conventional color slide or color print of the type containing couplers in the photosensitive emulsion layers thereof, diffusion resistant couplers are always left after processing and thus these problems have sufficiently been investigated by various persons and many almost stable and almost no discoloring couplers have already been known. Furthermore, in a conventional color photographic sensitive material, three kinds of couplers are left in three kinds of emulsion layers respectively, while in the present invention, only one kind of coupler is left usually and therefore, the amount of the remaining coupler is only one-half to one-third of the amount in the conventional case.

The step of separating the photosensitive material portion in this invention quickens and simplifies the process since the fixing and washing steps which require a long period of time are omitted and, in addition the whole transparency of the positive print obtained increases, the formation of stains is reduced, and the possibility of causing coloring and discoloring during preservation is also reduced. Moreover, the above step is also profitable in the point of recovering silver since the deposited photosensitive material portions are collected and the valuable silver salt remaining completely therein as a mixture of the undeveloped silver halide and the bleached silver image can be quite readily recovered. On the other hand, in a conventional color developing process, a fixing processing is usually conducted and in the case of conducting fixing, the greater parts of silver may be recovered electrolytically but a considerable part of silver is also lost in the water washing step and further in a each bath, the electrolytic recovery of silver is usually difficult. Also, one of the troubles caused in the electrolytic recovery is that the regeneration and reuse of the expensive processing solution are generally difficult.

On the other hand, in the process of this invention, the recovery of silver can be conducted independently of the photographic processing, that is, can be conducted by an inexpensive method, such as burn up independently of the regeneration of the processing solution. This is important for the economy in a color photographic laboratory and influences the cost of color photographs or color prints.

Now, the present invention will be illustrated in greater detail in conjunction with the following specific examples, which, however, are intended to be illustrative only.

EXAMPLE 1

In this example, the most general case wherein an image-receiving material and a photosensitive material are prepared separately is illustrated.

The image-receiving material was prepared as follows. A coupler solution having the following composition was prepared using the following $\alpha$-naphthol diffusion resistant coupler of the structural formula AM-2 previously indicated;

| | | |
|---|---|---|
| 1-Naphthol-2-carboxylic acid-(2'-N-stearyl-N-methylamino-4'-sulfo)-anilide sodium salt | 8.0 | g. |
| Dimethylformamide | 8.0 | ml. |
| 1% Aqueous trimethylamine solution | 80 | ml. |
| Water | 80 | liters |

The coupler solution prepared was disposed in the binder solution having the following composition;

| | | |
|---|---|---|
| Gelatin | 50 | g. |
| Polyvinylpyrrolidone | 10 | g. |
| Water | 1 | liter |

and the dispersion was coated on a water-proof paper such as a photographic baryta-coated paper in an amount of 60 g./m.$^2$ and dried to provide the image-receiving material of this invention.

A silver chloride emulsion color-sensitized in the red region was prepared and a mixture of 100 ml. of sodium hydroxide, 100 ml. of methanol, and 10 ml. of dimethylformamide having dissolved therein 10 g. of the aforesaid acridinic diffusion resistant amidrazone of the Type A, i.e., AM-3 was added to the silver chloride emulsion prepared above per one kilogram of emulsion. The mixture thus prepared was coated on a photographic paper (having on both surfaces thereof polyethylene coatings) in an amount of 70 g./m.$^2$. A solution prepared by dissolving 10 g. of AM-6 as the aforesaid diffusion resistant amidrazone of the Type B in a 5% aqueous solution per liter thereof was coated on the silver halide emulsion layer formed above in an amount of about 40 g./m.$^2$ as an intermediate layer. A silver chloride emulsion color-sensitized in the green region and having incorporated therein 10 g. of the aforesaid benzothiazolic diffusion resistant amidrazone of the Type A, i.e., AM-4 was further coated on the intermediate layer in an amount of about 70 g./m.$^2$. An intermediate layer containing the amidrazone of the Type B as indicated above was also coated on the silver halide emulsion layer in an amount of about 40 g./m. A (blue sensitive) silver chlorobromide emulsion which had not been color sensitized having incorporated therein 12 g. of AM-5 as the diffusion resistant amidrazone of the Type A per kilogram of the emulsion was then coated on the last intermediate layer in an amount of about 70 g./m.$^2$, and finally a 3% aqueous gelatin solution was over-coated thereon as a protective layer in an amount of about 30 g./m.$^2$ followed by drying to complete the photosensitive material.

The photosensitive material thus prepared was used to print by enlargement or photograph an aimed picture, color slide, or multi-color poster and then developed for 1 minute at 25°C. in an ordinary black and white developer having the following composition as in the case of ordinary photographic papers;

| | |
|---|---|
| Hydroquinone | 12.0 g. |
| Anhydrous sodium sulfite | 50.0 g. |
| Sodium carbonate (monohydrate) | 70.0 g. |
| 1-Phenyl-3-pyrazolidone | 0.5 g. |
| Potassium bromide | 2.0 g. |
| Benzotriazole | 0.2 g. |
| Water | 1.0 liter. |

After washing, the photosensitive material thus developed was withdrawn in the light and then superposed with the image-receiving layer of the image-receiving material which had been immersed for 1 minute at 25°C. in the oxidation treatment bath having the following composition;

| | |
|---|---|
| Water | 1.0 liter |
| Ferricyanide | 50.0 g. |
| Potassium bromide | 12.0 g. |
| Borax | 20.0 g. |
| Boric acid | 5.0 g. |

followed by squeezing. After an imbibition period of about 10 minutes, the silver image was almost bleached and the intermediate oxidation products of the amidrazones of the Type A which had become diffusible at the non-image portions were transferred by diffusion onto the image-receiving layer, whereby the intermediate products of the amidrazones were coupled with the α-naphtholic coupler to form a cyan dye in case of AM-3, a magenta dye in case of AN-4, and a yellow dye in case of AM-5. Thus, a color positive image having almost the same colors as the original was reproduced.

EXAMPLE 2

A combined photosensitive material prepared by coating a same support with an image-receiving material portion and then photosensitive material portions in a superposed relationship was used in this example.

About 170 ml. of a solution containing the same α-naphtholic diffusion coupler as in Example 1 was added to the binder solution containing dialdehyde starch as a polymer hardening agent and having the following composition

| | |
|---|---|
| Gelatin | 30 g. |
| Hydroxypropyl starch | 20 g. |
| Dialdehyde starch | 1 g. |
| Water | 1 liter |

and the mixture was coated on a subcoated triacetate base in an amount of about 60 g./m.$^2$ and then the solution having the following composition was coated on the layer prepared above in an amount of 30 g./m.$^2$ and dried to provide an intermediate layer, which acted also as an antihalation layer.

| | |
|---|---|
| Water | 600 ml. |
| Polyvinyl pyrrolidone | 30 g. |
| 10% Polyacrylamide solution | 100 ml. |
| 5% Saponin solution | 200 ml. |
| 10% Carbon black dispersion | 100 ml. |

Then, the same composition as that of the photosensitive material portion in Example 1 was coated on the intermediate layer and dried and in this case, in order to make smooth the removal of the photosensitive material portion after processing, 30 g. of carboxymethyl starch per liter of the coating composition had been incorporated in each coating composition for emulsion layers and the intermediate layer. That is, by incorporating the carboxymethyl starch, the photosensitive material portion could be removed easily in water. In this case, both the emulsion layer and the intermediate layer contained about 5% gelatin respectively as the binder and thus the content of the carboxymethyl starch was about 38% of the total binder therein, which was a quite proper amount. Thus, a roll film was prepared.

The photosensitive film thus prepared was exposed in a camera to an original, developed in a developer having the same composition as in Example 1 for one minute at 25°C., washed twice each with a 3% aqueous solution of magnesium sulfate, and a viscous composition prepared by adding 50 g. of carboxymethyl cellulose to the oxidation treatment solution having the same composition as in Example 1 was spread over the surface of the photosensitive film thus processed in an average amount of about 50 g./m.$^2$ Then, the film carrying the viscous composition was sandwiched by other film bases or rolled up so that the spread viscous composition layer did not dry. After an imbibition period of about 10 minutes, the cover films were removed or the rolled film was unrolled and then the film was placed in water, thereby the photosensitive material portion was easily removed together with the antihalation intermediate layer to provide immediately a color positive transparent image.

In addition, an other invention found by the inventors (Japanese Patent Publication No. 28,061/70) was also used in this example.

EXAMPLE 3

A dichromatic photosensitive material was prepared by coating an inexpensive water-proof paper, having coated on both surfaces thereof polyethylene coatings first with a silver chloride emulsion color-sensitized in the green region having added thereto 8 g. of AM-4-per kilogram of said silver chloride emulsion in an amount of about 70 g./m.$^2$ Then, an intermediate layer composition having the same composition as in Example 1 except that AM-7 was used in place of AM-6 was coated on the silver halide emulsion layer in an amount of about 40 g./m.$^2$, a silver chlorobromide emulsion which had not been color sensitized having added thereto 12 g. of AM-5 per kilogram of the silver halide emulsion was coated on the intermediate layer in an amount of about 70 g./m.$^2$, and further an aqueous gelatin solution was coated on the silver halide layer as a protective layer followed by drying to provide the photosensitive material.

By superposing the dichromatic photosensitive material with the image-receiving material having a layer containing the α-naphtholic coupler as in Example 1 and subjecting them to the same processings as in Example 1, a positive image of magenta and yellow (practically of various color tones including red which is a color mixing of magenta and yellow) was obtained. When the original used was made of the lines of magenta, yellow, and black, it was reproduced as the lines of magenta, yellow, and dark red.

EXAMPLE 4

As shown in the following formula, by heating 2-(m-aminophenyl-sulfonamido)-4-phenyl-thiazole and a copolymer of maleic anhydride and styrol in dimethylformamide, the polymer coupler having the following formula and having an excellent diffusion resistant property was obtained;

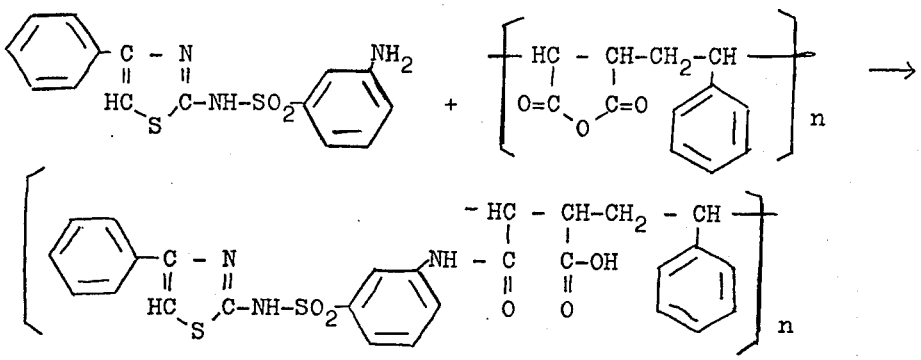

The coupler was dissolved in a mixture of 60 ml. of aqueous N-NaOH solution and 60 ml. of methanol, the solution was added to 500 ml. of a binder solution having the same composition as in Example 1, and the mixture was coated onto a photographic paper to provide an image-receiving paper. When the image-receiving paper thus prepared was superposed with the photosensitive material prepared by the same manner as in Example 3 and they were subjected to the same processings as in Example 1, the coupler was colored Therefore, the original formed by yellow, magenta, and black was reproduced as an image of orange, magenta, and dark red.

EXAMPLE 5

A dichromatic photosensitive material was prepared by the same manner as in Example 3 except that a silver chloride emulsion color sensitized in the red region was used in place of the silver chloride emulsion color sensitized in the green region. Also, an image-receiving material was prepared by dissolving in a mixture of 100 ml. of a N-NaOH solution and 100 ml. of methanol, 6 g. of 1-p-sulfophenyl-3-heptadecyl-5-imino-pyrazolone and 2'-chlorobenzoylaceto-2-hexadecyloxy-5-sulfoanilide each represented, respectively, by the formulae

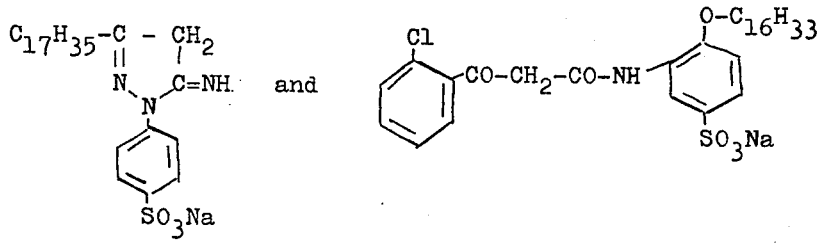

adding the solution thus prepared to a binder solution containing the hardening agent as in Example 2, and coating a photographic paper with the mixture in an amount of about 60 g./m.$^2$ The photosensitive material was exposed to an original formed by the lines of red, blue, and black, superposed with the image-receiving paper, and they were subjected to the same processings as in Example 1, whereby a reproduction of the original formed by the three colors of red, blue-green, and dark blue-black was obtained. The colors of the reproduction were clearly discriminated from each other although they were not exactly the same as those of the original. Furthermore, the photosensitive material was economically profitable because it has only two layers as silver halide emulsion layers as compared with a conventional photosensitive material having three silver halide emulsion layers.

EXAMPLE 6

The oil-soluble $\alpha$-naphtholic coupler having the following formula was used;

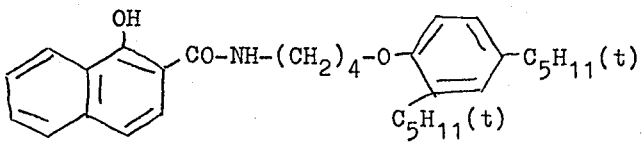

That is, 8 g. of the above coupler was dissolved in 24 g. of dibutyl phthalate, the solution was dispersed as fine oil droplets in one liter of a 5% aqueous gelatin solution, and the dispersion was coated on a transparent polyester base in an amount of about 60 g./m.$^2$ to provide an image-receiving material.

The image-receiving material thus prepared could be used for the same purposes as that of the image-receiving material in Example 1 and could make a color slide having a transparent positive image together with the photosensitive material in Example 1.

Furthermore, if the silver halide emulsion used for the photosensitive emulsion in Example 1 was replaced with a low sensitive and hard-tone silver halide emulsion, a combination of the photosensitive material and the image-receiving material prepared above is suitably used for reproducing transparent color designs for advertising and thus a comparatively inexpensive material for making color positives is obtained.

That is, a large size color plate for advertisement of the type of being placed along the walls of, e.g., an underground passageway and illuminated from the back side thereof by fluorescent lamps is usually prepared by cutting overall colored films into desired characters and figures and applying the cut characters or figures to the surface of an opal film; however, since such a conventional technique is made manually, and in view of the cost for making such an advertising plate, and since it takes a long period of time to make it, and thus such a conventional technique is unsuitable for making a large number of such advertizing plates. Thus, it is favorable and desirable if such advertizing plates can be obtained with low cost by photographic reproduction. However, if a commercially available color film is used for making such advertising plates, the materials thereof are expensive as well as the dyes for constituting the transparent positive image are insufficient in light fastness and thus when the advertizing plate made of such a color film is used for a long period of time, it is faded or discolored by the long illumination and thus the advertizing plate must be renewed, which makes the cost of them more expensive. On the other hand, in the color positive image forming material of this invention, the photosensitive material portion is a photographic paper and thus the advertising plate can be produced with a low cost. Furthermore, although the image-receiving material in this invention is made of a film, it is prepared by using only a single layer coating and also the reproduction of the color image thereon from the photosensitive material can be conducted in the light, which reduces considerably the production cost for the advertising plates. Moreover, because the dyes constituting the final color images are azo dyes and they are formed in oil droplets, the color images are greatly excellent in heat and moisture resistance and light resistance.

EXAMPLE 7

This example is concerned with a color positive forming material profitably used for making a few sheets of drawings made of a large number of lines such as a map for proofreading prior to make up. In fact, if a photosensitive material having three kinds of silver halide emulsion layers to be colored in three different colors as in Example 1 is used, the reproduction may be prepared more simply by the printing method same as the method that will be explained below but in this example, it was devised to make the materials with low cost and to be able to conduct the operation easily and in the light using photosensitive materials insensitive to red light.

A dichromatic photosensitive material same as the one described in detail in Example 3,i.e., the photosensitive material having a silver halide emulsion layer which had not been color-sensitized and contained AM-4, a silver halide emulsion layer which had been color-sensitized in the green region, and an intermediate layer containing AM-7 disposed between the both emulsion layers was prepared. Also, a black and white photosensitive material was prepared by coating an inexpensive water-proof paper, having both surfaces coated with polyethylene, with a non-color sensitized silver halide emulsion without the addition of the amidrazone in an amount of about 70 g./m.$^2$ Furthermore, an image-receiving paper containing the $\alpha$-naphtholic coupler as stated in Example 1 was prepared.

On the other hand, less than seven originals each prepared by writing black lines on a individual white paper with each color of a drawing were prepared and from those originals a transparent positive consisting of black lines was formed on a transparent film. These originals were superposed properly according the colors to be reproduced by the final printing as will be stated below and they were printed thrice while selecting proper silver filters and the both photosensitive materials. First, the dichromatic photosensitive material was then subjected to a black and white development and washing and then after superposing the photosensitive material with the aforesaid image-receiving paper, they were processed in an oxidation treatment solution as stated in detail in Example 3 or 1, thereby a transferred image made of the combination of magenta and yellow colors was obtained on the image-transfer paper.

On the other hand, the black and white photosensitive material printed from the suitable original was similarly subjected to a black and white development and washing and then immediately withdrawn in the light. The black and white photosensitive material and the image-receiving paper having in superposed relationship the transferred images of magenta and yellow were separately immersed for 30 seconds in the color developer having the following composition

| | |
|---|---|
| Sodium metaborate | 25.0 g. |
| Anhydrous sodium sulfite | 2.0 g. |
| Hydroxylamine sulfate | 2.0 g. |
| Potassium bromide | 0.5 g. |
| Sodium hydroxide | 4.0 g. |
| Benzyl alcohol | 20.0 ml. |
| Diethyleneglycol | 20.0 ml. |
| 5-(N-Methylsulfonamideethyl-N-ethyl)-amino-2-amino-toluidine sesquisulfate | 8.0 g. |
| Water to make | 1.0 liter. |

Thereafter, the black and white photosensitive material was superposed with the image bearing layer of the image-receiving material so that each of the images were at correct positions (this was made easily since the images could be seen with the naked eye followed by squeezing. After an imbibition period of about 10 minutes, the photosensitive material was separated, whereby the cyan positive image was superposed with the dichromatic image of magenta and yellow to provide immediately a reproduced figure made of less than 7 colors of three primary colors of cyan, magenta and yellow consisting of each individual primary color, three colors of green, and blue-purple at the portions where the both images were superposed over each other, and a dark brown or black color at the portions where the three colors were superposed.

In addition, at the practice of the aforesaid printings in this example, the following printing manners were required. That is, the original to be reproduced as magenta, red, blue-purple, and black colors including magenta component among the colors to be reproduced was superposed with the dichromatic photosensitive material and printed there on using a green filter for three-color separation printing. Then, the original was separated, another original to be reproduced as yellow, red, green and black colors including a yellow component was newly superposed with the photosensitive material and printed there using a blue-purple filter. On the other hand, the black and white photosensitive material was superposed with the original to be reproduced as cyan, blue-purple, green, and black colors including a cyan component and the original was printed to the photosensitive material with white light or using a blue-purple filter. The printings in this example were finished by conducting the aforesaid three printing operations.

What is claimed is:

1. A quick diffusion transfer process for forming a color positive image not requiring fixing thereof comprising:

a. imagewise exposing a photosensitive material which comprises at least two light-sensitive silver halide emulsion layers of different optical sensitivity separated by an intermediate layer, on a support, each of said layers containing an amidrazone compound represented by the formula:

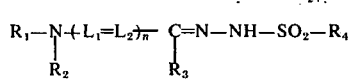

wherein $L_1$ and $L_2$ each represents —CH= or —N=; $n$ is 0 or 1; $R_1$, $R_2$, $R_3$ and $R_4$ each represents a hydrogen atom, an alkyl group, an aryl group, an aralkyl group, an alkylaryl group or said groups containing an O, S or N atom or said groups substituted by a halogen atom, a carboxylic acid residue or a sulfonic acid residue; wherein said $R_1$ may form a heterocyclic ring with said $R_2$; wherein said $R_2$ may form a ring with $R_3$ together with said —L= $L_2$—; wherein the amidrazone compounds in said silver halide emulsion layers have a ballasting group of at least 10 carbon atoms substituted in said $R_4$; and wherein the amidrazone compound present in said intermediate layer have a ballasting group of at least 10 carbon atoms substituted in said $R_1$, $R_2$ or $R_3$; each of the amidrazone compounds in each of said layers thereby having a diffusion-resistant property;

b. subjecting the exposed photosensitive material to a black and white development;

c. intimately contacting that surface of the photosensitive material away from the support with an image-receiving layer and, while contacted, subjecting the same to an oxidation treatment in a processing solution containing a ferricyanide, said image-receiving layer containing, dispersed in a binder therefor, a diffusion-resistant color coupler capable of oxidative coupling with the diffusable intermediate oxidation product of said amidrazone compounds formed by the oxidation treatment in said silver halide emulsion layers of said photosensitive material, whereby, said diffusable intermediate oxidation products diffusion-transfer from said silver halide emulsion layers into said image-receiving layer corresponding to said imagewise exposure and couple with said color coupler to form a color image in said image-receiving layer corresponding to said imagewise exposure; and d. removing said photosensitive material from contact with said image-receiving layer.

2. The process as claimed in claim 1 wherein said photosensitive material and said image-receiving layer are formed on separate supports, wherein the photosensitive material is subjected to imagewise exposure and then black and white development, wherein the photosensitive material and the image-receiving layer are then subjected to said oxidation treatment, and finally separating the photosensitive material from said image-receiving layer.

3. The process as claimed in claim 1 wherein said photosensitive material and said image-receiving layer are formed in layers on the same support and wherein after processing, only the photosensitive material is removed to provide on the support the desired color positive image in said image-receiving layer.

4. The process as claimed in claim 1 wherein said coupler capable of forming dyes by the oxidative couplings with the amidrazones is a phenol, an aromatic amine, or an active methylene compound.

5. The process as claimed in claim 1, wherein said photosensitive material comprises two or three light-sensitive silver halide emulsion layers.

6. A photosensitive combined material for forming a color positive image comprising a photosensitive material portion and an image-receiving material portion in intimate contact, said photosensitive material portion comprising at least two photosensitive silver halide emulsion layers of different optical sensitivity and an intermediate layer disposed between the two silver halide emulsion layers, each of said layers of the photosensitive material portion containing an amidrazone represented by the general formula

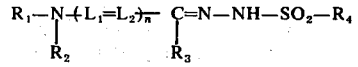

wherein $L_1$ and $L_2$ each represents —CH= or —N=; $n$ is 0 or 1; and $R_1$, $R_2$, $R_3$ and $R_4$ each represents a hydrogen atom, an alkyl group, an aryl group, an aralkyl group, an alkylaryl group or said groups containing an O, S, or N atom, or said groups substituted by a carboxylic acid residue, a sulfonic acid residue, or a halogen atom; wherein said $R_1$ may form a heterocyclic ring with said $R_2$; wherein said $R_2$ may form a ring with said $R_3$ together with said —$L_1$ = $L_2$; wherein the amidrazone compounds present in said intermediate layer have a ballasting group of at least 10 carbon atoms substituted in said $R_1$, $R_2$ or $R_3$; wherein the amidrazone compounds present in said silver halide emulsion layers have a ballasting group of at least 10 carbon atoms substituted in said $R_4$; each of the amidrazone compounds in each of said layers thereby having a diffusion-resistant property; said image-receiving material portion comprising an image-receiving layer containing, dispersed in a binder therefor, a diffusion-resistant color coupler capable of forming color dyes by oxidative coupling with the intermediate oxidation product of said amidrazones.

7. The photosensitive combined material of claim 6 wherein said photosensitive material portion and said image-receiving material are formed on separate supports.

8. The photosensitive combined material of claim 6 wherein said photosensitive material portion and said image-receiving material are formed on the same support.

9. The photosensitive combined material of claim 8 wherein said photosensitive material comprises two or three photosensitive silver halide emulsion layers.

* * * * *

UNITED STATES PATENT AND TRADEMARK OFFICE

CERTIFICATE OF CORRECTION

PATENT NO. : 3,933,493

DATED : January 20, 1976

INVENTOR(S) : Yasushi OHYAMA et al

It is certified that error appears in the above-identified patent and that said Letters Patent are hereby corrected as shown below:

IN THE HEADING:

Under Foreign Application Priority Data, Japanese Application Number should be - - 46-48576 - -

Signed and Sealed this

*fourth* Day of *May 1976*

[SEAL]

*Attest:*

RUTH C. MASON
*Attesting Officer*

C. MARSHALL DANN
*Commissioner of Patents and Trademarks*